United States Patent [19]

Churla

[11] 4,051,323

[45] Sept. 27, 1977

[54] CONNECTOR FOR COUPLING A GROUND CONDUCTOR TO THE SHIELD OF A SHIELDED CONDUCTOR

[75] Inventor: John J. Churla, Belle Mead, N.J.

[73] Assignee: Thomas & Betts Corporation, Elizabeth, N.J.

[21] Appl. No.: 732,331

[22] Filed: Oct. 14, 1976

[51] Int. Cl.[2] ..... H01R 5/10

[52] U.S. Cl. ..... 174/78; 174/84 C

[58] Field of Search ..... 174/75 C, 78, 84 C, 174/90, 94 R; 339/95 R, 96, 97 C, 98, 223 R, 276 R, 276 T; 24/115 A, 129 W, 243 A; 16/108, 109; 403/274, 278, 281, 285, 391

[56] References Cited

U.S. PATENT DOCUMENTS 3,549,787 12/1970 Churla, Jr. ..... 174/78

*Primary Examiner*—Laramie E. Askin

[57] ABSTRACT

The disclosure is directed to a wrap-around type of connector for coupling the exposed shield of a jacketed cable from which a portion of the jacket has been removed to a grounding conductor. The connector is generally C-shaped with one free end portion having a greater radius of curvature than the other free end to permit one free end to pass over the other as the connector is closed on the cable shield. A tab is struck from the central portion of the connector to divide the interior of the connector into a cable receiving cavity and a ground conductor receiving cavity. By selectively adding strengthening ribs and removing material the various portions of the connector are made to function, as described. The connector can be made bare, or insulated, as required.

9 Claims, 11 Drawing Figures

CONNECTOR FOR COUPLING A GROUND CONDUCTOR TO THE SHIELD OF A SHIELDED CONDUCTOR

BACKGROUND OF THE INVENTION

1. Field of the Invention:

The invention is directed to a connector for coupling a cable to a terminal point and more particularly for coupling the shield of a cable to a grounding point.

2. Description of the Prior Art:

One wrap-around type of connector for coupling a ground conductor to the exposed shield of a jacketed cable is shown in U.S. Patent Ser. No. 3,549,787 Entitled, "Connector for Coupling a Ground Conductor to the Shield of a Shielded Conductor", by John J. Churla, Jr., issued Dec. 22, 1970 and assigned to the assignee of the instant invention. This connector does well with small solid ground conductors or flexible stranded ground conductors, and with shielded conductors where the shield has some strength to it or is well supported by the dielectric it surrounds. With large sized ground conductors and flexible shields, or dielectrics, it is possible that the ground conductor tab will not be urged about the ground conductor as the connector is installed about the shielded cable but will, instead, be held open enough to be forced through the shield and into, or through, the dielectric making contact to and shorting the shield to the central conductor. Also, even if the tab closes about a solid, large ground conductor, the entire conductor remains within the wrap of the connector and can prevent the full closure of the connector or distort the dielectric and thereby change the cable's characteristics.

SUMMARY OF THE INVENTION:

The present invention overcomes the possible problems with wrap-around connectors for connecting a ground conductor to the shield of a shielded conductor as shown by the cited prior art connector. This is achieved by providing a generally C-shaped connector body with one end having a smaller radius of curvature than the other end and by providing a central tap shaped in the general contour of the adjacent connector end. Further, the tab is spaced from adjacent connector portions by spaces which can receive the ground conductor and permit same to be carried over an exterior surface of the tab and outside of the connector, thereby preventing any build-up of material that would interfere with the connector closure or interfere with the functioning of the cable. The selective placement of stiffening ribs and slots on the connector and tab facilitates the closure of the connector about the shield of the shielded conductor as well as the securing of the ground conductor to such connector. It is therefore an object of this invention to provide an improved connector.

It is another object of this invention to provide an improved connector for coupling a ground conductor to the shield of a shielded conductor.

It is another object of this invention to provide an improved connector to connect a ground conductor to the shield of a shielded conductor where a portion of the ground conductor extends on the exterior of the connector to minimize the overall size of the joint between the ground conductor and shielded conductor.

It is still another object of this invention to provide an improved connector for connecting a ground conductor to the shield of a shielded conductor wherein a tab to retain the ground conductor divides the interior of the connector into a shielded connector receiving cavity and a ground conductor cavity, whereby the ground conductor is not permitted to directly contact the conductor shield to prevent injury thereto.

Other objects and features of the invention will be pointed out in the following description and claims and illustrated in the accompanying drawings, which disclose, by way of example, the principles of the invention, and the best mode which has been contemplated for carrying them out.

BRIEF DESCRIPTION OF THE DRAWING:

In the drawings in which similar elements are given similar reference characters.

Figure 6:
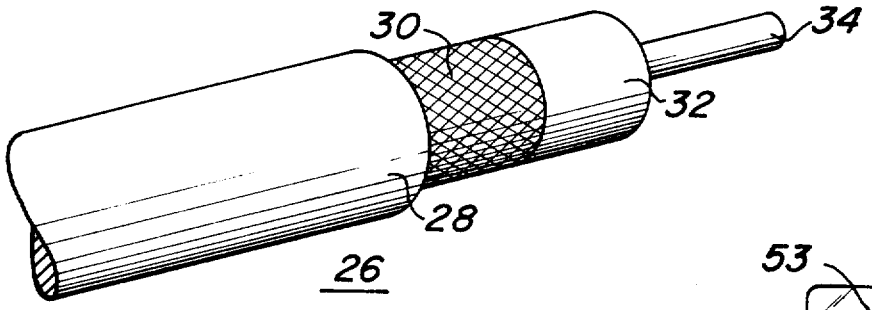
FIG. 6 is a fragmentary, front perspective view of a shielded, jacketed cable with a portion of the jacket, at the cable end, removed to expose the shield, a portion of the shield removed to expose the dielectric below the shield and with a portion of the dielectric removed to expose the central metallic conductor.
Figure 9:
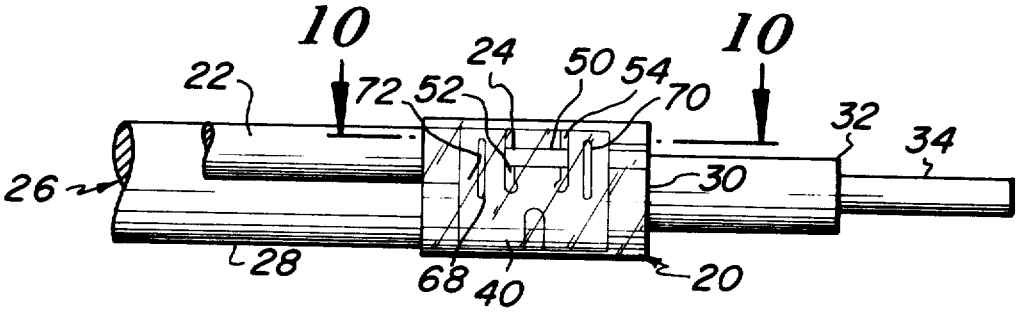
FIG. 9 is an exterior elevational view of the installed connector, cable and conductor, as shown in FIG. 8.

DESCRIPTION OF THE PREFERRED EMBODIMENT:

Turning now to FIGS. 1 to 4 there is shown a connector 20 for connecting the bared metallic portion 24 of a ground conductor 22 to the shield 30 of a jacketed, shielded cable 26 from which a portion of a jacket 28 has been removed (See FIG. 9). A jacketed, shielded cable 26 is shown in FIG. 6 wherein a portion of the outer rubber, plastic or other dielectric material jacket 28 has been removed to expose the shield 30. The shield 30, usually a braid made up of copper wires, tinned copper wires or the like which can provide a ground plane about the central conductor to control the transmission characteristics of the cable, prevents or reduces the radiation of signals in the cable and prevents or reduces the effect of external signals upon the signals in the cable.

Figure 5:
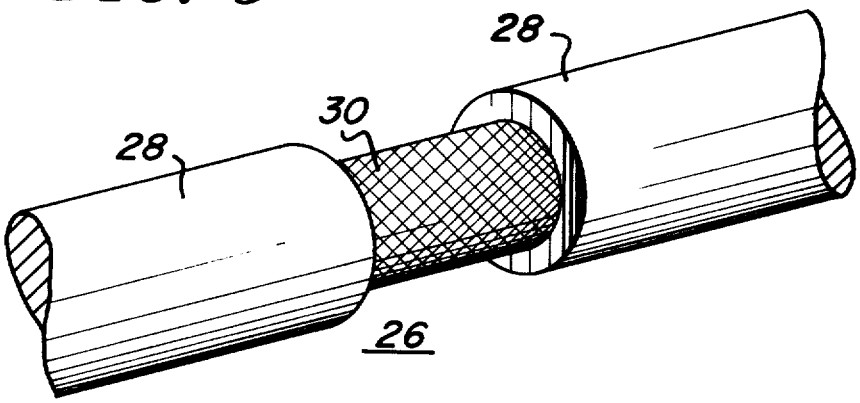
FIG. 5 is a fragmentary, front perspective view of a shielded jacketed cable with a midspan portion of the jacket removed to expose the shield.

A portion of the shield 30 has been removed to expose the dielectric layer 32 and a portion of the dielectric layer 32 is removed to expose the metallic central conductor 34 which carries the signal. The cable 26 of FIG. 6 is prepared to be terminated at one end of the cable 26. The central conductor 34 will be connected to the signal generating device, or the signal using device, (both not shown) and the shield 30 will be connected via a ground conductor (see conductor 22 in FIG. 9) to a grounding point (not shown). FIG. 5 shows a shielded, jacketed cable 26 prepared for a midspan coupling of a ground conductor to the cable 26. Midspan refers to the connection at a location other than at the cable ends. As shown in FIG. 5, the jacket 28 of the cable 26 has been removed at a central location of the fragment of the cable 26 shown to expose the shield 30 thereunder.

Figure 7:
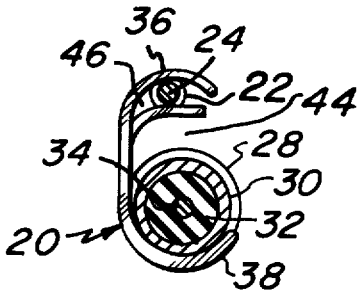
FIG. 7 is a side elevational view of the connector of FIG. 1 positioned about the shield of a shielded, jacketed cable from which a portion of the jacket has been removed and with a ground conductor installed, the connector being in its condition prior to installation.
Figure 8:
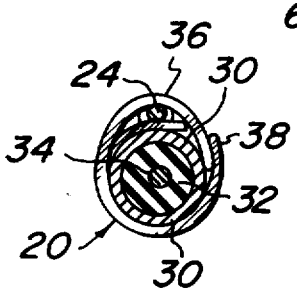
FIG. 8 is a side elevational view of the connector cable and conductor positions after the connector of FIG. 1 has been fully installed.

Returning now to FIGS. 1 to 4, connector 20 has a generally C-shaped appearance with a first curved end 36 having a first radius of curvature and a second curved end 38 with a predetermined radius of curvature greater than the radius of curvature of first curved end 36. The radii are so chosen that first curved end 36 is permitted to move within second curved end 38 and second curved end 38 is permitted to move over the first curved end 36 as the connector 20 is wrapped about the shield 30 of a cable 26 in the manner shown in FIG. 8, to be described below. A tab 42 is struck from the central portion 40 of the connector 20 and is provided with a third radius of curvature larger than those of the curved ends 36, 38. The tab 42 serves to divide the interior portion of the connector 20, generally described by the central portion 40 and the two curved ends 36,38, into a shield receiving chamber 44 and a ground conductor receiving chamber 46. As is shown in FIG. 7, the exposed shield 30 of the shielded, jacketed cable 26 is positioned within the shield receiving chamber 44 defined by the interior surface 48 of tab 42, the central portion 40 and the second curved end 38 of connector 20. The bared metallic portion 24 of the ground conductor 22 is inserted within the ground conductor receiving chamber 46 defined by the exterior surface 50 of the tab 42 and the first curved end 36 of the connector 20.

Figure 3A:
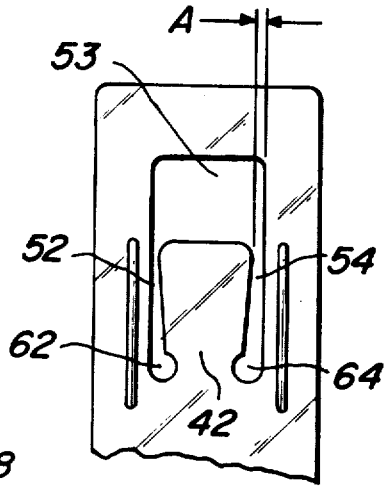
FIG. 3A is a fragmentary, enlarged view of a portion of the connector of FIG. 3.
Figure 10:
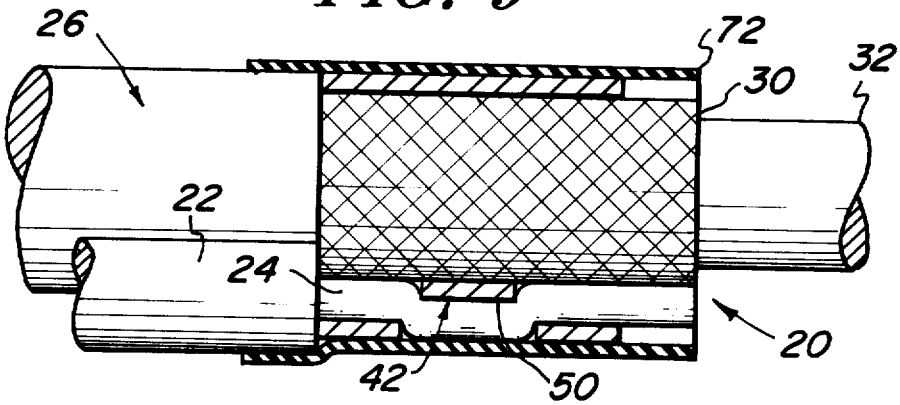
FIG. 10 is a top view, partially in section, of the joint shown in FIG. 9 and taken along the line 10—10.

The tab 42 is struck from the central portion 40 of the connector 20 so as to leave channels 52,54 between the lateral edges of the tab 42 and the adjacent edges of the central portion 40. The channels 52,54 permit the bared metallic portion 24 to exit from the ground conductor receiving cavity 46 and pass over the exterior 50 of the tab 42 and then back into cavity 46, as is shown in FIGS. 9 and 10. This path of the bared metallic portion 24 of the ground conductor 22 minimizes the direct contact between portion 24 and the shield 30 and thus minimizes the possible distortion of the shield 30 and dielectric 32, permits the connector 20 to be more closely wrapped about the shield 30 and minimizes the size of the joint between connector 20, cable 26 and ground conductor 22. The marginal edges 56,58 of tab 42 are outwardly flared, or tapered, as shown in FIG. 3A, to provide a restricted path for a conductor placed in the slots 52,54. Thus, the opening width A is so chosen that a conductor is not permitted to pass out of the slots 52,54. At the free end of tab 42 is a large window 53 created by the removal of the metal of connector 20 when tab 42 is formed. This large window 53, as will be described further below, provides an open area where the free end of tab 42 can go as the connector 20 is crimped. The tab 42 can exit the joint and thus not injure the shield 30 or dielectric 32 as it could if it were required to remain inside of the joint and conform to the shape of the jacketed cable 26. The lateral edges of the tab 42 are folded up towards first curved end 36 and coined to provide sharpened edges 56,58 (See FIG. 4) which will bite into the bared metallic portion 24 of ground conductor 22 and better hold onto a solid metallic portion 24 of ground conductor 22. The tab 42 is slightly dished as at 60 thereby giving rise to strengthening ribs inward of the edges 56,58 (see FIG. 4) and the tab 42 is formed with its lateral edges 56,58 tapered outwardly in the direction of the first curved end 36. The effect of taper of the tab 42, the dishing 60 and the edges 56,58 is to cause the bared portion 24 of the ground conductor 22 to move towards first curved end 36 as the connector 20 is wrapped about shield 30 (See FIG. 8). As was set out above, the spacing of edges 56,58 of tab 42 from the walls defining the slots 52,54 prevents the ground conductor bared portion 24 from disengaging from the exterior surface 50 of tab 42. The tab 42 moves towards the window 53 and into it rather than moving into further contact with the shield 30, which could injure the dielectric 32, as discussed above.

The channels 52,54 terminate in apertures 62,64, respectively which enhances movement of the tab 42. A slot 66 in the central portion 40 extends towards and into the second curved end 38 facilitating the closure of the second curved end 38 about the shield 30 and over first curved end 36. Strengthening ribs 68,70 generally flank the tab 42 and provide some rigidity to prevent the first curved end 36 from being deflected outwardly as the portion 24 of ground conductor 22 moves towards end 36 and thus interferes with the relative movements of the curved ends 36,38, as above described.

Figure 1:
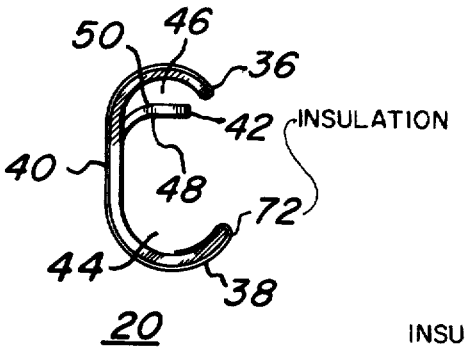
FIG. 1 is a side elevational view of a connector for coupling a ground conductor to the shield of a shielded conductor constructed in accordance with the concepts of the invention.
Figure 2:
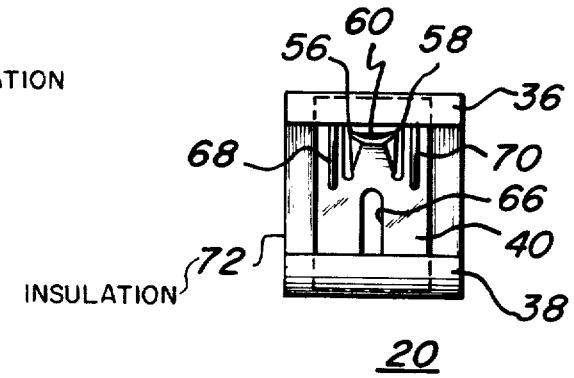
FIG. 2 is a front elevational view of the connector of FIG. 1.
Figure 3:
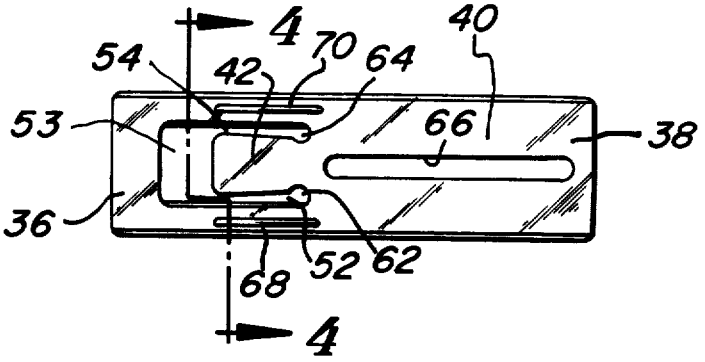
FIG. 3 is a top plane view of the inside of the blank of the connector of FIG. 1 prior to forming to the configuration of FIG. 1.
Figure 4:
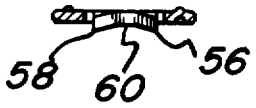
FIG. 4 is a top plan view, partially in section, of the connector of FIG. 1 taken along the lines 4—4 in FIG. 3.

The connector 20 can be provided bare where insulation of the joint is not required, or where the entire joint is to be later insulated. Also, the connector 20 can be provided with its own insulation layer whereby no secondary insulation operation is necessary. A layer of suitable insulation material such as plastic, rubber, varnish, films, or other suitable materials may be employed. FIGS. 1 and 2 illustrate the use of a thin plastic film 72 which extends about the exterior surface of connector 20 and around the ends to cover a small portion of first and second curved ends 36,38. The film 72 is made wider than connector 20 to prevent contact with the connector 20 ends. The films 72 is joined to itself at either side of the first and second curved ends, 36,38. This entraps the connector 20 and prevents lateral movement. If desired, the excess film can be used as a carrier strip for continuous strip use and the foldover joints will hold the connectors in position and alignment.

Further, as shown in FIGS. 9 and 10, the insulation layer 72 can be used as a strain relief. In FIG. 9 the left marginal portion of insulation 72 that extends beyond connector 20 overlies the insulated portions of conductor 22 and cable 26 changing the flexing point to a point outside of the connector and thus away from the joint of connector 20 with cable 26. The right marginal edge of insulation 72 extends beyond shield 30 and similarly moves the flexure point outside of connector 20 thereby protecting the joint and lessening any pressures on the ground conductor 22 and shield 30.

While there have been shown and described and pointed out the fundamental novel features of the invention as applied to the preferred embodiment, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A connector for grounding the exposed shield of a jacketed shielded conductor from which a portion of the jacket has been removed to expose the shield, said connector being of the type having a central portion being preformed in a generally C-shaped configuration and having a first curved end portion of a first predetermined radius of curvature and a second curved end portion of a second predetermined radius of curvature larger than said first predetermined radius of curvature, said first curved end portion moving within said second curved end portion when said cental portion is wrapped about the exposed shield of a shielded conductor, the improvement comprising: an aperture in said central portion, said aperture defined by first and second generally parallel edges extending in the direction from said first curved end portion towards said second curved end portion and third and fourth edges each extending generally transverse to said first and second edges; a tab having an interior surface and an exterior surface and extending from said third edge and generally overlying said aperture; said tab having a first edge generally parallel with said first edge defining a portion of said aperture and a second edge generally parallel with said second edge defining a portion of said aperture; said tab having a first strengthening rib adjacent said tab's first edge and a second strengthening rib adjacent said tab's second edge, said tab's first and second strengthening ribs preventing the bending of said tab as said connector is brought into intimate contact with the exposed shield of a shielded conductor; said tab being curved and having a third predetermined radius of curvature greater than said first predetermined radius of curvature; said interior surface of said tab and said second curved end portion defining therebetween a shielded conductor receiving cavity, and the exterior surface of said tab and said first curved end portion defining therebetween a ground conductor receiving cavity; said first curved end portion moving within said second curved end portion as said connector is brought into intimate contact with the exposed shield of a shielded conductor when placed in said shielded conductor receiving cavity and said moving first curved end portion closing said ground conductor receiving cavity upon a ground conductor when placed therein.

2. A connector as defined in claim 1, wherein said tab first edge is spaced apart from said first edge defining a portion of said aperture and said tab second edge is spaced apart from said second edge defining a portion of said aperture to permit a ground conductor when placed in said ground conductor receiving cavity to pass between said tab first edge and said first edge defining a portion of said aperture, over said exterior surface of said tab and between said tab second edge and said second edge defining a portion of said aperture as said connector is brought into intimate contact with the exposed shield of a shielded conductor.

3. A connector as defined in claim 1, further including a slot in said second curved end portion extending in a direction towards said first curved portion to weaken said second curved portion to facilitate the movement of said second curved portion.

4. A connector for grounding the exposed shield of a jacketed shielded conductor from which a portion of the jacket has been removed to expose the shield, said connector being of the type having a central portion being preformed in a generally C-shaped configuration and having a first curved end portion of a first predetermined radius of curvature and a second curved end portion of a second predetermined radius of curvature larger than said first predetermined radius of curvature, said first curved end portion moving within said second curved end portion when said central portion is wrapped about the exposed shield of a shielded conductor, the improvement comprising: an aperture in said central portion, said aperture defined by first and second generally parallel edges extending in the direction from said first curved end portion towards said second curved end portion and third and fourth edges each extending generally transverse to said first and second edges; a tab having an interior surface and an exterior surface and extending from said third edge and generally overlying said aperture; two strengthening ribs in said central portion extending parallel with said first and second edges; said strengthening ribs making said central portion stronger than said first curved end portion and said second curved end portion to maintain the position of said tab while permitting the movement of said first curved end portion and said second curved end portion as said connector is brought into intimate contact with the exposed shield of a shielded conductor said tab having a first edge generally parallel with said first edge defining portion of said aperture and a second edge generally parallel with said second edge defining a portion of said aperture; said tab having a first strengthening rib adjacent said tab's first edge and a second strengthening rib adjacent said tab's second edge, said tab's first and second strengthening ribs preventing the bending of said tab as said connector is brought into intimate contact with the exposed shield of a shielded conductor, said tab being curved and having a third predetermined radius of curvature greater than said first predetermined radius of curvature; said interior surface of said tab and said second curved end portion defining therebetween a shielded conductor receiving cavity, and the exterior surface of said tab and said first curved end portion defining therebetween a ground conductor receiving cavity; said first curved end portion moving within said second curved end portion as said connector is brought into intimate contact with the exposed shield of a shielded conductor when placed in said shielded conductor receiving cavity and said moving first curved end portion closing said ground conductor receiving cavity upon a ground conductor when placed therein.

5. A connector for grounding the exposed shield of a jacketed shielded conductor from which a portion of the jacket has been removed to expose the shield, said connector being of the type having a central portion being preformed in a generally C-shaped configuration and having a first curved end portion of a first predetermined radius of curvature and a second curved end portion of a second predetermined radius of curvature larger than said first predetermined radius of curvature, said first curved end portion moving within said second curved end portion when said central portion is wrapped about the exposed shield of a shielded conductor, the improvement comprising: an aperture in said central portion, said aperture defined by first and second generally parallel edges extending in the direction from said first curved end portion towards said second curved end portion and third and fourth edges each extending generally transverse to said first and second edges; an insulation layer on the outside of said central portion, the outside of said first curved end portion and the outside of said second curved end portion, said insulation layer extending over the free ends of said first curved end portion and said second curved end portion and along a portion of the inside of said first and said second curved portions respectively, said insulation layer being wider than said connector and held in place by coupling at the portion of said insulation which extends beyond said connector, the portions of the insulation layer on the inside of said first and second curved end portions to said insulation layer on the outside of said first and second curved end portions, respectively; a tab having an interior surface and an exterior surface and extending from said third edge and generally overlying said aperture; said tab having a first edge generally parallel with said first edge defining a portion of said aperture and a second edge generally parallel with said second edge defining a portion of said aperture; said tab having a first strengthening rib adjacent said tab's first edge and a second strengthening rib adjacent said tab's second edge, said tab's first and second strengthening ribs preventing the bending of said tab as said connector is brought into intimate contact with the exposed shield of a shielded conductor, said tab being curved and having a third predetermined radius of curvature greater than said first predetermined radius of curvature; said interior surface of said tab and said second curved end portion defining therebetween a shielded conductor receiving cavity, and the exterior surface of said tab and said first curved end portion defining therebetween a ground conductor receiving cavity; said first curved end portion moving within said second curved end portion as said connector is brought into intimate contact with the exposed shield of a shielded conductor when placed in said shielded conductor receiving cavity and said moving first curved end portion closing said ground conductor receiving cavity upon a ground conductor when placed therein.

6. A connector for grounding the exposed shield of a jacketed shielded conductor from which a portion of the jacket has been removed to expose the shield said connector being of the type having a central portion being preformed in a generally C-shaped configuration and having a first curved end portion of a first predetermined radius of curvature and a second curved end portion of a second predetermined radius of curvature larger than said first predetermined radius of curvature, said first curved end portion moving within said second curved end portion when said central portion is wrapped about the exposed shield of a shielded conductor, the improvement comprising: an aperture in said central portion, said aperture defined by first and second generally parallel edges extending in the direction from said first curved end portion towards said second curved end portion and third and fourth edges each extending generally transverse to said first and second edges; a tab having an interior surface and an exterior surface and extending from said third edge and generally overlying said aperture; said tab being curved and having a third predetermined radius of curvature greater than said first predetermined radius of curvature; said interior surface of said tab and said second curved end portion defining therebetween a shielded conductor receiving cavity, and the exterior surface of said tab and said first curved end portion defining therebetween a ground conductor receiving cavity said tab having a first edge at an acute angle to and spaced apart from said first edge defining a portion of said aperture and a second edge at an acute angle to and spaced apart from said second edge defining a portion of said aperture to permit a ground conductor when placed in said ground conductor receiving cavity to pass between said tab first edge and said first edge defining a portion of said aperture, over said exterior surface of said tab and between said tab second edge and said second edge defining a portion of said aperture as said connector is brought into intimate contact with the exposed shield of a shielded conductor so that a ground conductor will be trapped by said tab; said first curved end portion moving within said second curved end portion as said connector is brought into intimate contact with the exposed shield of a shielded conductor when placed in said shielded conductor receiving cavity and said moving first curved end portion closing said ground conductor receiving cavity upon a ground conductor when placed therein.

7. A connector as defined in claim 6, further including a slot in said second curved end portion extending in a direction towards said first curved portion to weaken said second curved portion to facilitate the movement of said second curve portion.

8. A connector for grounding the exposed shield of a jacketed shielded conductor from which a portion of the jacket has been removed to expose the shield, said connector being of the type having a central portion being preformed in a generally C-shaped configuration and having a first curved end portion of a first predetermined radius of curvature and a second curved end portion of a second predetermined radius of curvature larger than said first predetermined radius of curvature, said first curved end portion moving within said second curved end portion when said central portion is wrapped about the exposed shield of a shielded conductor, the improvement comprising; an aperture in said central portion, said aperture defined by first and second generally parallel edges extending in the direction from said first curved end portion towards said second curved end portion and third and fourth edges each extending generally transverse to said first and second edges; a tab having an interior surface and an exterior surface and extending from said third edge and generally overlying said aperture; two strengthening ribs in said central portion extending parallel with said first and second edges; said strengthening ribs making said central portion stronger than said first curved end portion and said second curved end portion to maintain the position of said tab while permitting the movement of said first curved end portion and said second curved end portion as said connector is brought into intimate contact with the exposed shield of a shielded conductor; said tab being curved and having a third predetermined radius of curvature greater than said first predetermined radius of curvature; said interior surface of said tab and said second curved end portion defining therebetween a shielded conductor receiving cavity, and the exterior surface of said tab and said first curved end portion defining therebetween a ground conductor receiving cavity said tab having a first edge at an acute angle to and spaced apart from said first edge deining a portion of said aperture and a second edge at an acute angle to and spaced apart from said second edge defining a portion of said aperture to permit a ground conductor when placed in said ground conductor receiving cavity to pass between said tab first edge and said first edge defining a portion of said aperture, over said exterior surface of said tab and between said tab second edge and said second edge defining a portion of said aperture as said connector is brought into intimate contact with the exposed shield of a shielded conductor so that a ground conductor will be trapped by said tab; said first curved end portion moving within said second curved end portion as said connector is brought into intimate contact with the exposed shield of a shielded conductor when placed in said shielded conductor receiving cavity and said moving first curved end portion closing said ground conductor receiving cavity upon a ground conductor when placed therein.

9. A connector for grounding the exposed shield of a jacketed shielded conductor from which a portion of the jacket has been removed to exposed the shield, said connector being of the type having a central portion being preformed in a generally C-shaped configuration and having a first curved end portion of a first predetermined radius of curvature and a second curved end portion of a second predetermined radius of curvature larger than said first predetermined radius if curvature, said first curved end portion moving within said second curved end portion when said central portion is wrapped about the exposed shield of a shielded conductor, the improvement comprising: an aperture in said central portion, said aperture defined by first and second generally parallel edges extending in the direction from said first curved end portion towards said second curved end portion and third and fourth edges each extending generally transverse to said first and second edges; an insulation layer on the outside of said central portion, the outside of said first curved end portion and the outside of said second curved end portion, said insulation layer extending over the free ends of said first curved end portion and said second curved end portion and along a portion of the inside of said first and said second curved portions respectively, said insulation layer being wider than said connector and held in place by coupling at the portion of said insulation which extends beyond said connector, the portions of the insulation layer on the inside of said first and second curved end portions to said insulation layer on the outside of said first and second curved end portions, respectively; a tab having an interior surface and an exterior surface and extending from said third edge and generally overlying said aperture; said tab being curved and having a third predetermined radius of curvature greater than said first predetermined radius of curvature; said interior surface of said tab and said second curved end portion defining therebetween a shielded conductor receiving cavity, and the exterior surface of said tab and said first curved end portion defining therebetween a ground conductor receiving cavity said tab having a first edge at an acute angle to and spaced apart from said first edge defining a portion of said aperture and a second edge at an acute angle to and spaced apart from said second edge defining a portion of said aperture to permit a ground conductor when placed in said ground conductor receiving cavity to pass between said tab first edge and said first edge defining a portion of said aperture, over said exterior surface of said tab and between said tab second edge and said second edge defining a portion of said aperture as said connector is brought into intimate contact with the exposed shield of a shielded conductor so that a ground conductor will be trapped by said tab; said first curved end portion moving within said second curved end portion as said connector is brought into intimate contact with the exposed shield of a shielded conductor when placed in said shielded conductor receiving cavity and said moving first curved end portion closing said ground conductor receiving cavity upon a ground conductor when placed therein.

* * * * *